US005505231A

United States Patent [19]

Bassing

[11] Patent Number: 5,505,231

[45] Date of Patent: Apr. 9, 1996

[54] PROJECTILE GUIDING ELEMENTS SYNCHRONOUSLY MOVABLE WITH A FULL WIDTH POWER LOOM SLEY

[75] Inventor: Friedrich W. Bassing, Emsdetten, Germany

[73] Assignee: Jürgens Maschinenbau GmbH & Co. KG, Emsdetten, Germany

[21] Appl. No.: 212,040

[22] Filed: Mar. 11, 1994

[30] Foreign Application Priority Data

Mar. 11, 1993 [DE] Germany ..... 43 08 243.2

[51] Int. Cl.[6] ..... D03D 49/60

[52] U.S. Cl. ..... 139/188 R

[58] Field of Search ..... 139/188 R, 449, 139/446, 1 R

[56] References Cited

U.S. PATENT DOCUMENTS

| | | | |
|---|---|---|---|
| 2,793,658 | 5/1957 | Dunham . | |
| 4,422,482 | 12/1983 | Hintsch . | |
| 4,438,790 | 3/1984 | Steiner | 139/188 R |
| 4,473,096 | 9/1984 | Brouwer et al. | 138/188 R |
| 4,546,803 | 10/1985 | Dornier . | |
| 4,628,968 | 12/1986 | Burer . | |
| 5,303,747 | 4/1994 | Arndt et al. | 139/449 |

FOREIGN PATENT DOCUMENTS

| | | |
|---|---|---|
| 1535561 | 7/1970 | Germany . |
| 2758454 | 5/1979 | Germany . |
| 3242121 | 5/1984 | Germany . |
| 3831927 | 3/1990 | Germany . |

*Primary Examiner*—Andy Falik
*Attorney, Agent, or Firm*—Michael J. Striker

[57] ABSTRACT

A full width power loom which produces flat woven paper machine webs and other articles with warp and weft threads and which has a width more than 6 meters has a sley reciprocable in a direction of warp threads, a thread introducing element formed as a projectile, a shooting end catching mechanism for the projectile, and guiding elements for guiding the projectile. The guiding elements exclusively guide the projectile and are movable synchronously with the sley.

17 Claims, 8 Drawing Sheets

PROJECTILE GUIDING ELEMENTS SYNCHRONOUSLY MOVABLE WITH A FULL WIDTH POWER LOOM SLEY

BACKGROUND OF THE INVENTION

The present invention relates to a full width power loom, in particular for producing flat woven paper machine webs or other technical fabrics with warp and weft threads, for example with widths of more than 6 meters, which has a sley reciprocatable in direction of warp threads.

The present invention also relates to a method of operating a power loom as well as to a method of moving guiding elements for a projectile of power looms with reciprocatingly swinging sleys.

Power looms for producing flat woven paper machine webs and similar technical fabrics, which have widths of 6–12 meter and are subjected to high warp tension and sley impact forces up to 5 tons/meter of weaving width are special power looms and are not comparable with the class of the textile weaving machines. Characteristic features of the textile weaving machines are their small weaving width, their high shooting number per minute and their light construction corresponding to these conditions. They are characterized by a drive for the sley which is conventional for this weaving machine and provided through a swinging shaft which carries a sley support for supporting the sley and which moves with the sley support in an angle synchronous member. The drive of the swinging shaft is performed in these machines through a cam transmission shown in FIG. 10. While the above described special power looms operate in correspondence with the current technology with a shooting number of approximately 50 shots/minute, the textile power looms run with mechanical shooting action of more than 100 shots/minute and power looms with pneumatic shooting process run with up to 1,000 shots/minute and more.

An important reason for the relatively low shooting numbers in the special power looms is that the shooting is performed by so-called gripper shuttles, in which due to their dimensions and their mass which must be not only accelerated but also mounted reliably and in accurate positions relative to the stand do not permit higher shooting numbers.

It has been attempted to miniaturize the gripper shuttles. However, the respective attempts are limited by the fact that the gripper shuttles due to their dimensions and reduced weight when they are shut through the shed become instable and in extreme cases fly out of the shed. One of example of such a miniaturized gripper shuttle is disclosed in the German patent DT 15 35 561. The instable shuttle flight limits also the shooting speed and thereby the productivity increase of these machines.

The German patent DE-A1 32 42 121 discloses that the disadvantages of the instable shuttle run can be eliminated when the guiding elements for the shuttles are provided. While the construction disclosed here prevents flying out of the shuttles, this system however has disadvantages in that the shuttles roll along the warp threads of the undershed which is supported on the sley. In the case of a not clean undershed or overpacking of the web blade, or in other words when not all warp threads of the Undershed are located exactly near one another, but partially overlap one another, this acts in a breaking fashion on the shuttle and also influences the productivity increase of the machine.

SUMMARY OF THE INVENTION

Accordingly, it is an object of the present invention to provide a full width power loom which is designed so as to eliminate the above mentioned disadvantages and eliminate a productivity increase in these special power looms.

In keeping with these objects and with others which will become apparent hereinafter, one feature of the present invention resides, briefly stated, in a power loom in which a shooting and catching mechanism for a projectile as well as guiding elements for guiding the projectile are provided, wherein the guiding elements are synchronously movable with a sley. When the power loom is designed in accordance with the present invention, in a surprising manner based on a shooting system known from the textile power looms also in full width power looms a productivity increase can be obtained.

In accordance with the present invention a second movement is superposed on the guiding elements. For this purpose the guiding elements which are required for guiding the projectile after the shooting lower out of the shed and no longer disturb the impact of the weaver's reed on the fabric edge. Therefore, there is here a movement component which is superposed substantially in a perpendicular direction to the warp threads in addition to conventional sley movement which is performed substantially in direction of the warp threads on a circular arc.

This movement which additional activates an exit of the guiding elements from the shed can be obtained in that a second movement is superposed on the sley. When the sley moves synchronously additionally in the perpendicular direction, the guiding elements can be mounted directly on the sley so that they must not perform any relative movement with respect to the sley.

The masses which in the case of additional movement components must be accelerated and again decelerated, are reduced in advantageous manner when the guiding elements are mounted on a guiding rail which is turnable about a turning point arranged on the sley.

Structuraly the additional movement component can be superposed despite the higher mass of the sley when the guiding elements are fixedly mounted on the sley. The sley is formed turnable about a rotary point which itself is turnably articulated on a lever with a stationary rotary point, and the lever preferably is driven from a cam disc.

The required precision in the cooperation of various movement components can be obtained in a favorable manner when the superposed movements are obtained from a joint drive shaft. This can be achieved when the drive shaft is formed as a crankshaft with a connecting rod as a drive for the sley, and preferably is provided with a bearing ring for a guiding support rail. The guiding support rail has an articulation point of the sley and is connected through a hinge with a bearing ring which is freely rotatable on the crankshaft and operates as a stationary impact point.

For improving the quality of the weaving, the sley is provided with a reed which is arranged in the front reversing point of the sley perpendicular to the central shed plane. The impact is performed in direction of the warp threads.

For eliminating mechanical problems caused by great weaving widths, high impact forces, high accelerating and decelerating masses, it is advantageous when the sley has more than two sley supports. The sley supports can be formed as a part of a kinematic quadrilateral link in a sley drive with a crankshaft.

The drive can be formed as the crankshaft with one or several cam disc transmissions which preferably are arranged symmetrically to a center of the full width power loom, in particular as a complementary camshaft transmission. With this construction the full width power loom can be formed with the required width, without sacrificing precision of the movements by torsion of the drive shaft.

The precise time control of the different movements is also obtained when the movements of the sley and the guiding elements are mechanically synchronized. For synchronization of the cam disc transmission, in particular a synchronizing shaft connecting the drive can be provided.

For the same purpose the movement of the guiding elements can be provided mechanically, for example by a link system, from the movement of the sley. For this purpose the guiding elements can be articulated through a lever system on one hand with a turning point fixed relative to the machine frame and on the other hand with the turning point moving with the sley. The drive is performed therefore through the sley.

For eliminating errors and for providing bend free weaving, it is advantageous when the cover loom is separated from the shooting and catching mechanism by a coupling and is formed reversible. In the reverse movement sequence the fabric is moved however in the direction opposite to the weaving direction without shooting. A linear drive can be used for the superposed movement, in particular cylinder-piston units, which is advantageous especially for movement of the guiding elements. In accordance with another embodiment of the invention, the shooting and catching mechanism is formed swinging with the sley.

The inventive method is performed in such a way that a second movement is additionally superposed on the guiding elements. With this method the sley movement can be independent from the required exchange movement of the guiding elements. The sley movement can be also maintained with a minimum amplitude, which with the same productivity or in other words with the same shooting number means lower accelerations and decelerations of the respective masses. As a result the mass forces acting on the machine are reduced, which contributes a quieter machine operation. On the other hand, with the same loading the shooting number can be correspondingly increased and the productivity therefore is improved. Finally, the direction of the impact is performed independent from the exchange movement of the guiding elements. The impact is performed in direction of the warp threads. The impact with a sley directed perpendicularly to the plane of the warp threads is performed relatively close to its clamping point, so that the high impact forces are controllable by the short clamping length of the reed. The inventive method can also be performed by superposing a second movement on the sley. The guiding elements can be then fixedly mounted on the sley.

The movable masses in the full width power looms can be reduced when due to the use of the projectile shooting and catching mechanism on the full width power looms with the width of more than 6 meters, the conventional great and massive guiding paths for guiding the gripper shuttles are replaced by the guiding elements for the projectile.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 9:
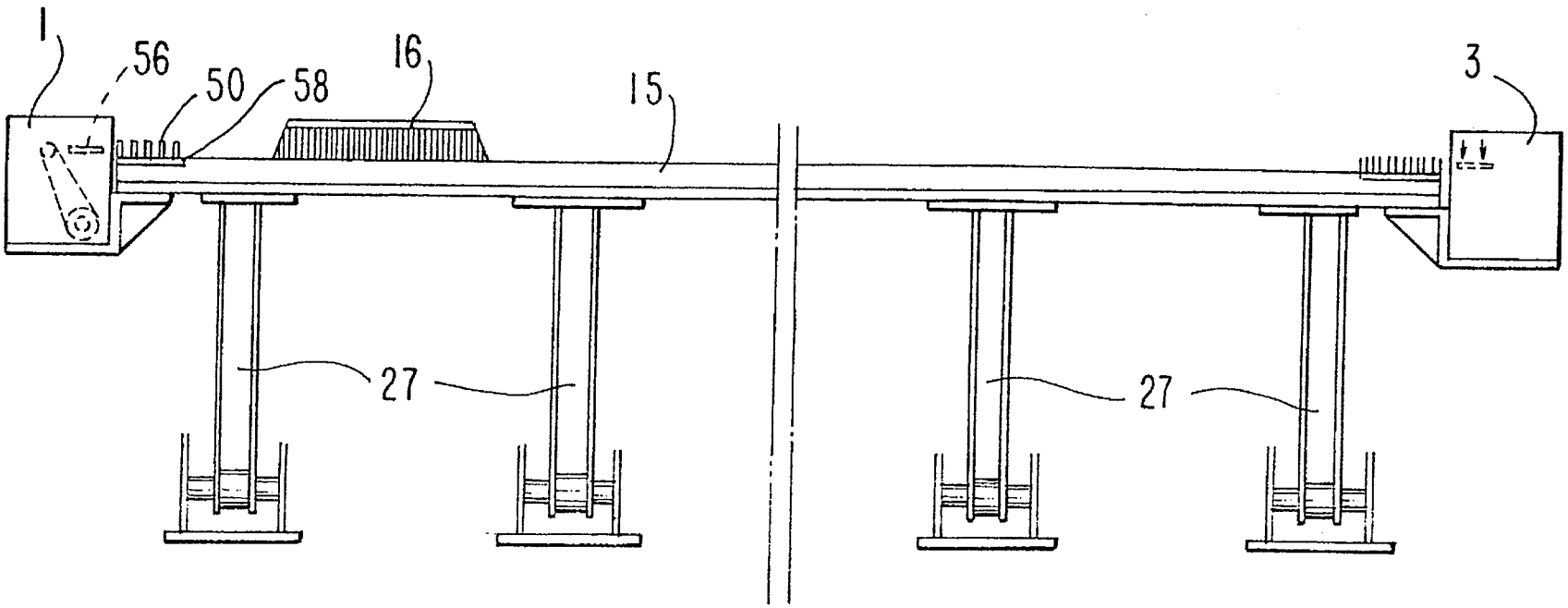
Figure 10:
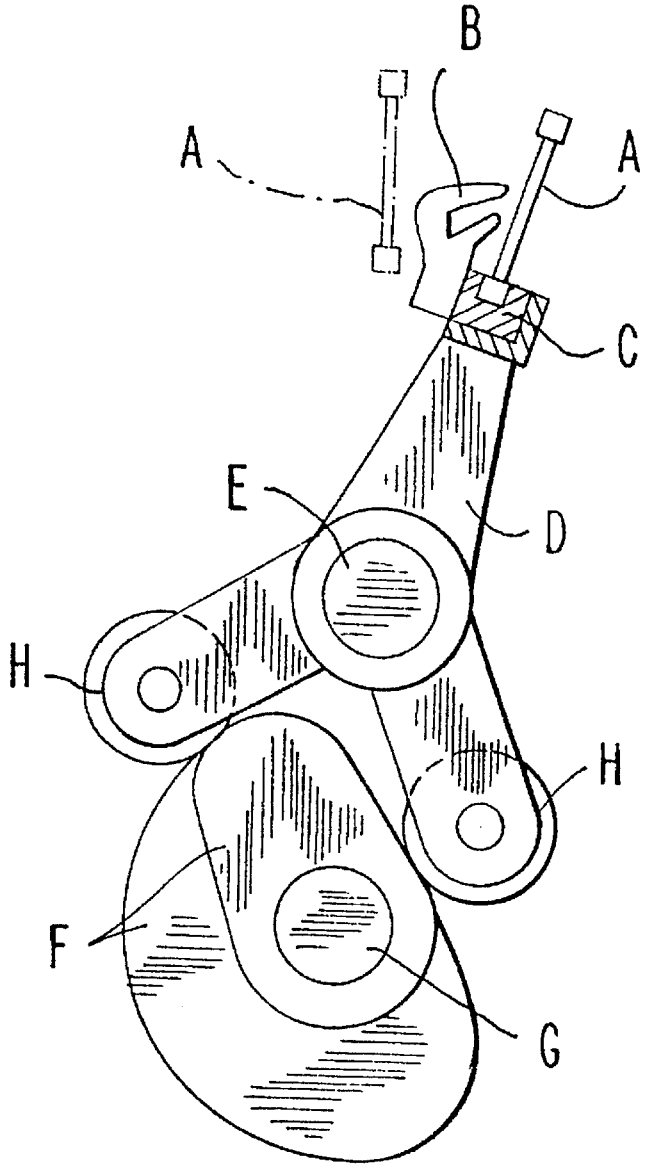
FIG. 10 PRIOR ART

FIG. S is a view showing an alternative embodiment of a drive for the projectile guiding elements mounted on the sley;

FIG. 9 is a view showing an alternative arrangement of a shooting and catching mechanism movable with the sley; and FIG. 10 is a view showing a typical sley drive for power looms with a swinging shaft and a cam disc drive in a schematic illustration.

DESCRIPTION OF THE PREFERRED EMBODIMENTS

FIG. 10 for better understanding of differences between the full width power looms illustrates first a typical sley drive for shuttleless textile power looms.

A reed A and guiding teeth B are mounted together on a sley support C, which extends over the whole width of the power loom. The sley support C is fixedly connected with the multiple support D which in turn are all fixedly connected with a swinging shaft E. The swinging shaft E and the elements A, B, C and D mounted on it perform an angle synchronous movement under the action of a cam disc drive F with a rotary point G and a two-arm roller lever H which is also fixedly connected with the swinging shaft E. This relatively low-mass sley drive System due to the substantially high loads in the full width power looms and the considerable kinematic energies required here cannot be practically used for the sley impact.

Figure 1:
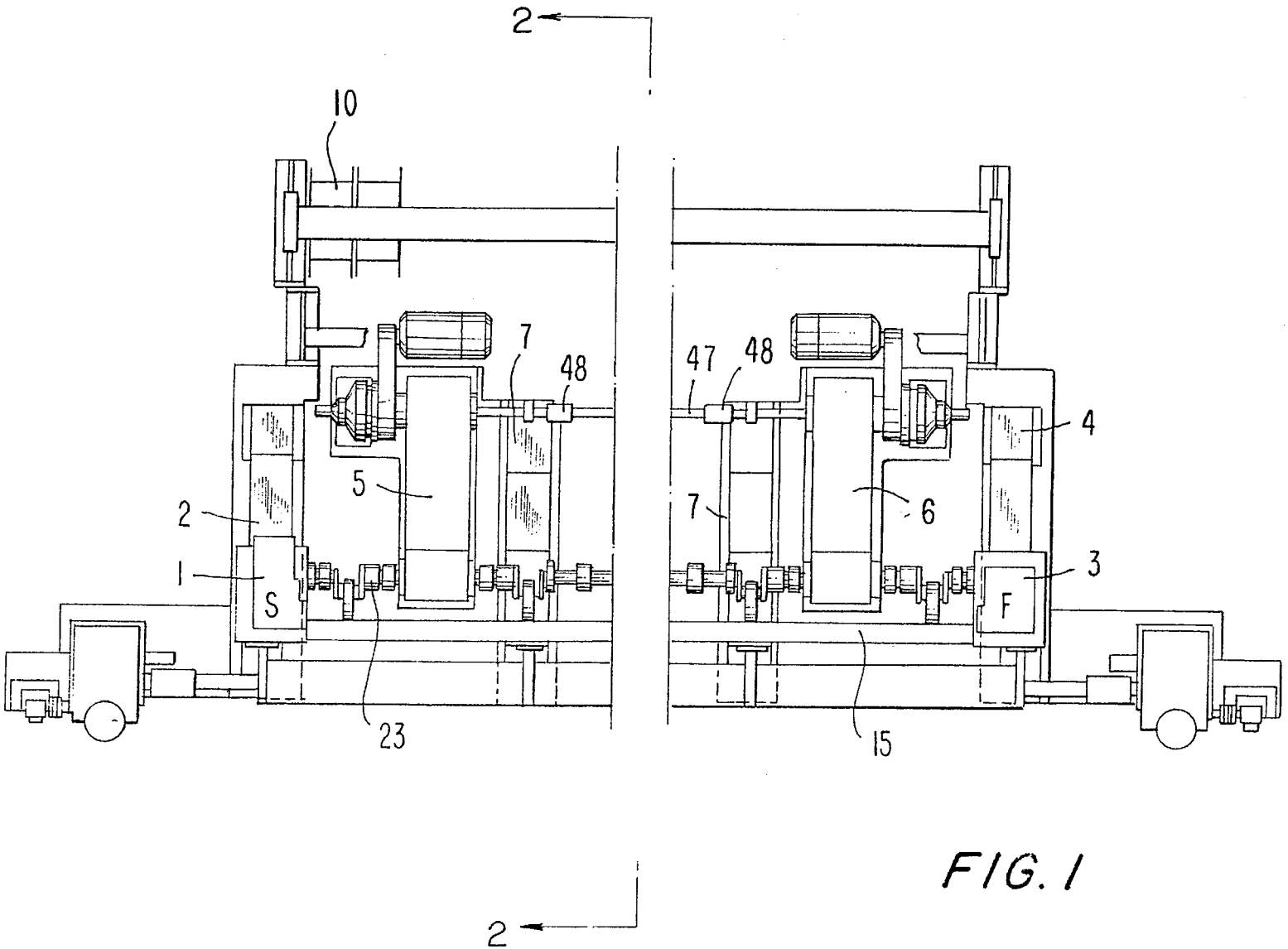
FIG. 1 is a plan view of a projectile power loom with respective elements and its position in a schematic illustration.
Figure 2:
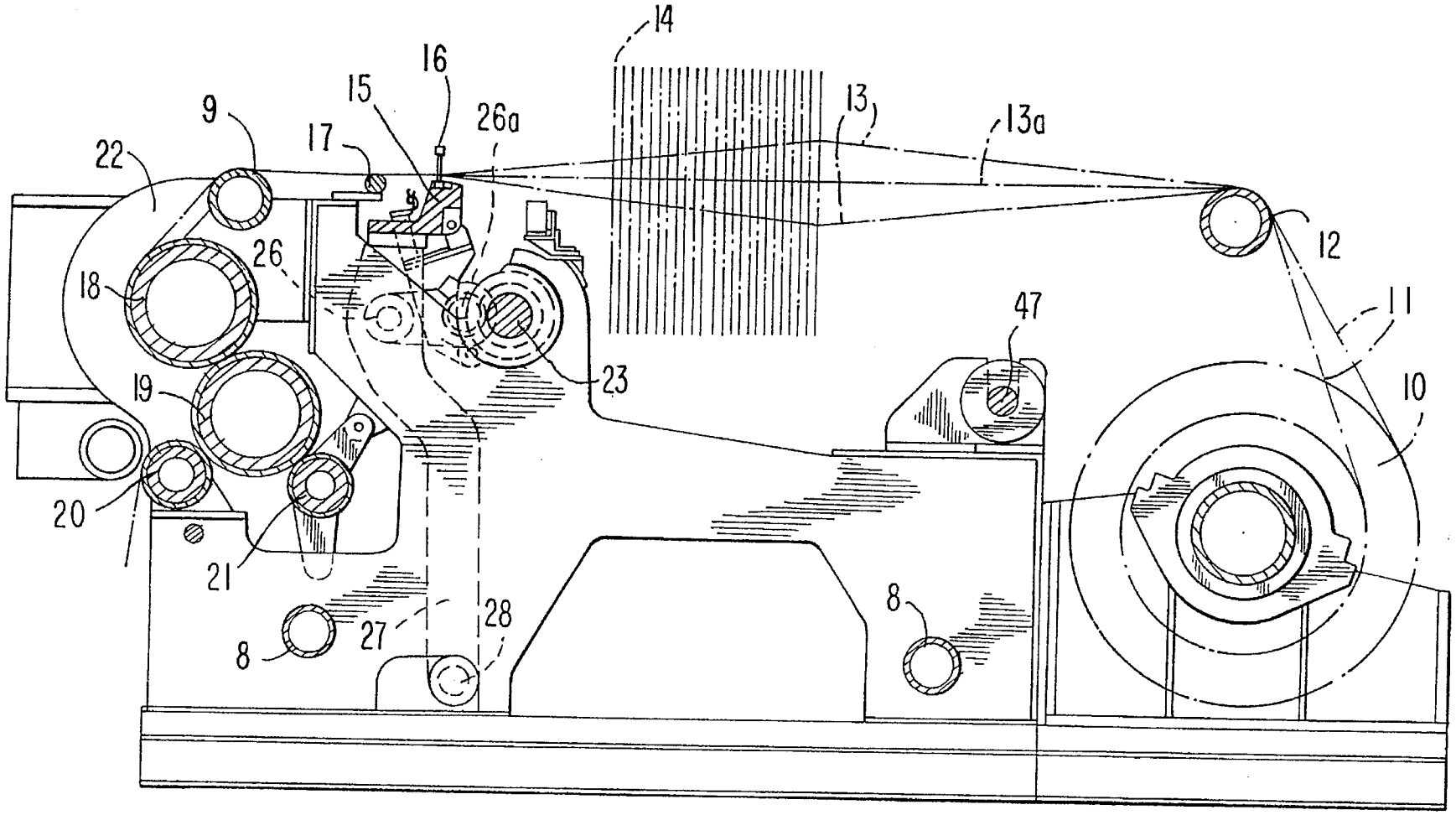
FIG. 2 is a view showing a section of the inventive projectile power loom taken along the line II—II in FIG. 1.

A projectile power loom in accordance with the present invention shown in FIG. 1 has a left outer frame wall 2 which supports a shooting mechanism 1 and a right outer frame wall 4 which supports a catching mechanism 3. A main drive 5 is located at the left machine side and a further main drive 6 is located at a right machine side between the housing walls 2 and 4, and more than two central machine walls 7 are located between them depending on the machine width. As can be seen from FIG. 2, the outer frame walls 2 and 4, the main drives 5 and 6, and the central frame walls 7 are connected with one another by a modular tubular longitudinal connector 8 and a breast roll 9 so as to form a so-called frame.

A warp 11 coming from a warp beam 10 is deflected over a spreader tube 12 and runs through heddle eyes 13 of shafts 14 and then through a reed 16 mounted on a sley carrier 15 and through a vertically adjustable round rail 17 on the breast roll 9. The formation of the shaft is performed by known shaft machines. Due to the shooting performed perpendicularly to the warp thread direction the formation of a fabric or article is performed in the front dead point position of the reed 16 at the front edge.

The article formed here runs over the round rail 17 and is deviated by the breast roll 9 into the roller system of a drawing-off area composed of rollers 18, 19, 20, 21 and a drawing-off transmission 22. It is drawn off in correspondence with the respective weft density. The reciprocating crankshaft 23 which extends over the whole width of the power loom is supported at both sides between the breast roll 9 and the pack of the shafts 14.

Figure 3:
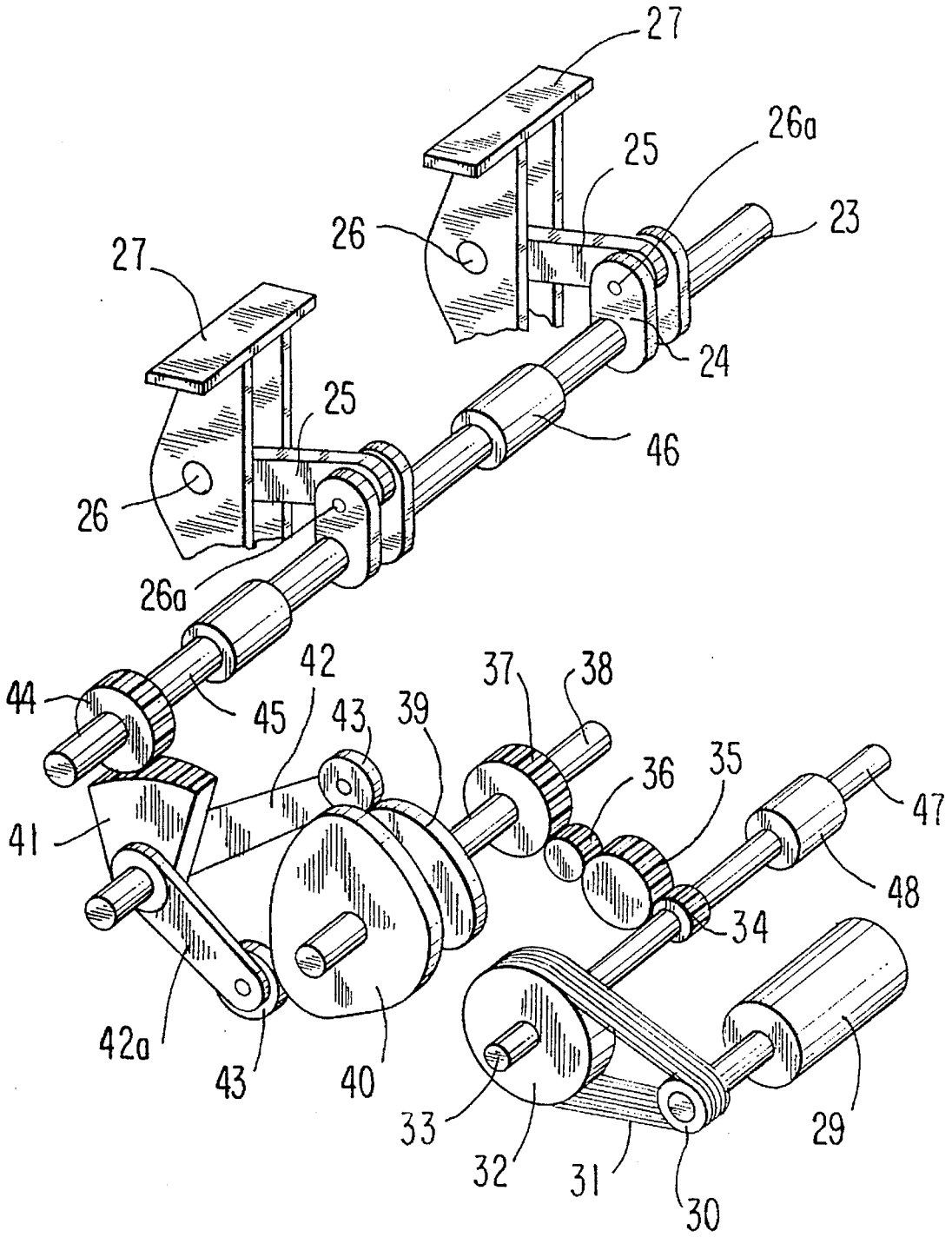
FIG. 3 is a perspective view of a drive system of the inventive power loom for a sley movement.

The crankshaft is shown on a perspective view in FIG. 3 with its drive. Crank arms 25 with a rotary point 26*a* are rotatably articulated in a crank 24 of the crankshaft 23 and transmit their movement in the rotary point 26 on a sley support 27 which is in turn moved around the rotary point 28 in FIG. 2.

Figure 4:
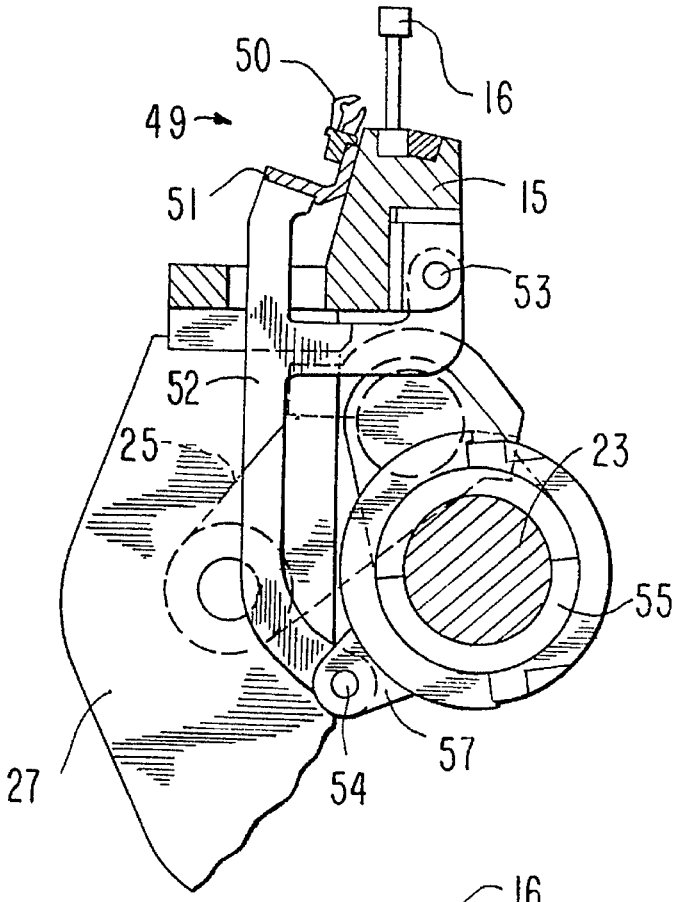
FIG. 4 is a view showing a section of a sley of the inventive full width power loom with a projectile guiding system in a rear dead point position.
Figure 5:
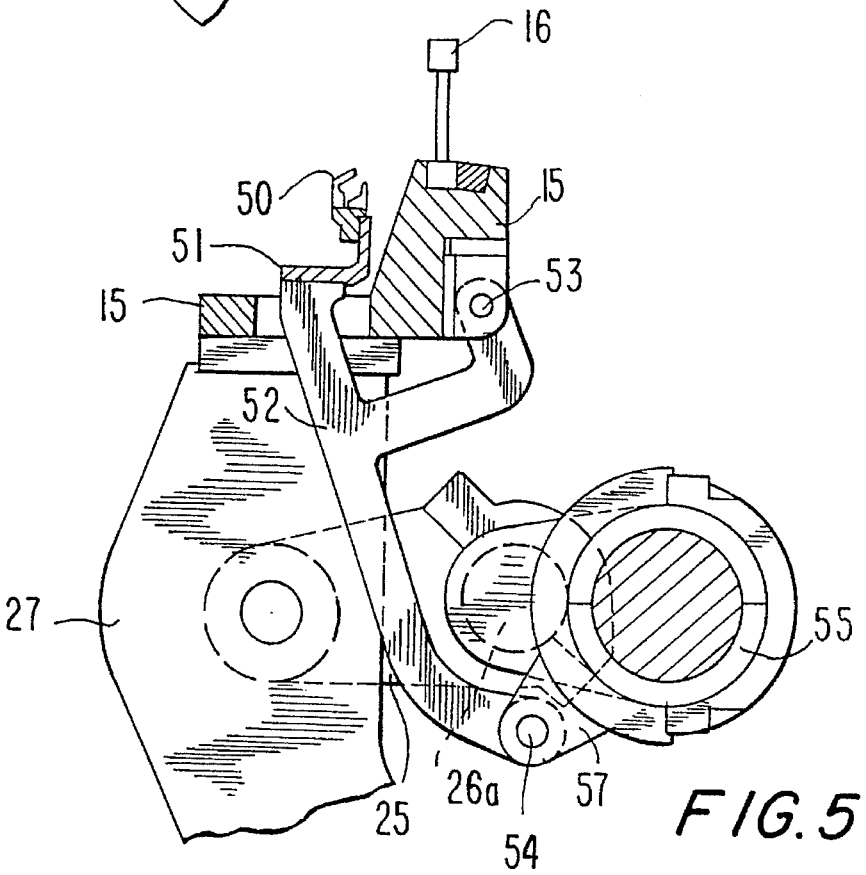
FIG. 5 is a view showing a section of the sley with the projectile guiding system in a front dead point position.

A sley carrier 15 is mounted on the sley support 27 as shown in FIGS. 4 and 5 and reciprocates with it. During the arresting at the rear dead point position of the sley 15 the shooting charge is performed and in the front dead point position the shooting impact against the fabric edge is performed. The drive of the crankshaft 23 is performed in accordance with the present invention through the main transmissions 5 and 6 shown in FIG. 1, wherein one of them is schematically shown in FIG. 3 without the housing.

The preferably selected three phase motor 29 transmits its movement through a cone belt disc 30 and a cone belt transmission 31 to a coupleable drive disc 32 arranged on an input drive shaft 33 of the main drive. A cam disc wheel 37 is driven through a pinion 34 fixedly connected with the drive shaft 33 and intermediate wheels 35 and 36. It is connected with a complementary cam disc shaft 38 on complementary cam discs 39 and 40 mounted on it which in turn actuate a swinging movement of a toothed segment 41 through arms 42 and 42*a* located on the tooth segment and also through cam rollers 43. The swinging movement is transmitted to a camshaft output member 45 through a wheel 44 engaging with the toothed segment 41. The connection of the individual crank strokes in correspondence with the modular construction, is performed by shaft couplings 46. The synchronization of the main drives 5 and 6 arranged at the left side and the right side of the machine center is performed through a synchronous shaft 47 which runs fast in relation to the camshaft and connects both drives 5 and 6 through a coupling 48.

The sley carrier 15 mounted on the sley support 27 over the whole weaving width is shown together with the clamped reed 16 in section in FIGS. 4 and 5. The sley carrier is simultaneously the base for a projectile guiding system 49 composed of guiding elements 50, a guiding rail 1, a transmission lever 52, the width rotary points 53, and 54, and a bearing ring 55 sitting on the crankshaft 23 for the rotary point 54 in a bracket 57. The bearing ring 55 is supported freely rotatably on the crankshaft 23. The guiding system 49 with the guiding elements 50 mounted on the guiding carrier rail 51 extends over the whole weaving width. In the rear sley position shown in FIG. 4 the shooting charge is performed by a projectile 56 of FIG. 9. For this purpose it is required that the guiding elements 50 are arranged completely flush to the outlet passage of the shooting mechanism 1 of FIG. 1. This is achieved kinematically by the link arrangement of the guiding system. For stabilizing of the end position the leg of the guiding carrier rail 51 which supports the guiding elements 50 is brought by not shown springy means in abutment against the surface of the sley carrier 15 extending parallel to the leg.

After the shooting charge which is performed with the stationary reed, the sley carrier 15 swings to the front dead point position shown in FIG. 5 and ties the weft threads. The projectile guiding system 49 with the guiding elements 50 exclusively guides the projectile 56, and performs a relative movement with respect to the sley 15 and the reed 16 due to the arrangement of the hinge points 53 and 54 to the rotary point of the crankshaft 53, so that the guiding elements 50 before the striking of the reed 16 in the front dead point are forcedly moved from the lower shed of the warp threads.

Figure 6:
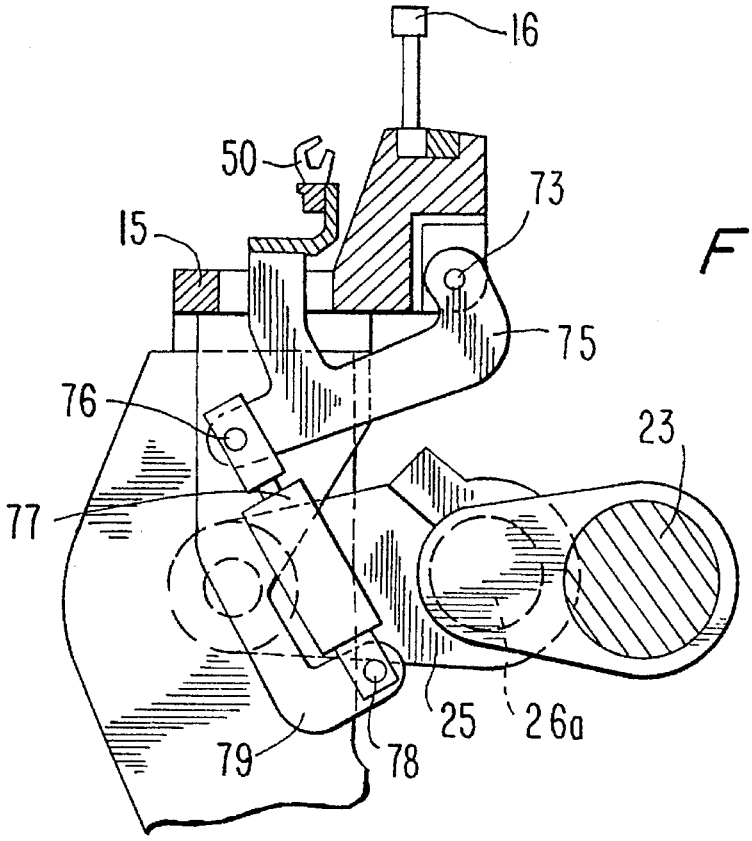
FIG. 6 is a view showing an alternative embodiment of a drive for the guiding elements with electrical, pneumatic or hydraulic means.

Another embodiment is shown in FIG. 6. Support bearing 79 and rotary point 73 for a movement lever 75 are arranged on the sley carrier 15. A linear drive 77 abuts against the rotary point 78 of the support bearing 79 and can be formed for example as a cylinder-piston unit or a magnetic drive. At the other end the drive 77 engages the rotary point 76 of the movement lever 75. The drive 77 performs a stroke movement via a not shown machine control, and the stroke movement acts so that the guiding elements 50 which are fixedly connected through the guiding carrier rail 51 with the movement lever 75 are located at the time of the shooting charge in the weaving shed and after the performed shooting charge moved before the sley impact again from the weaving shed.

Figure 7:
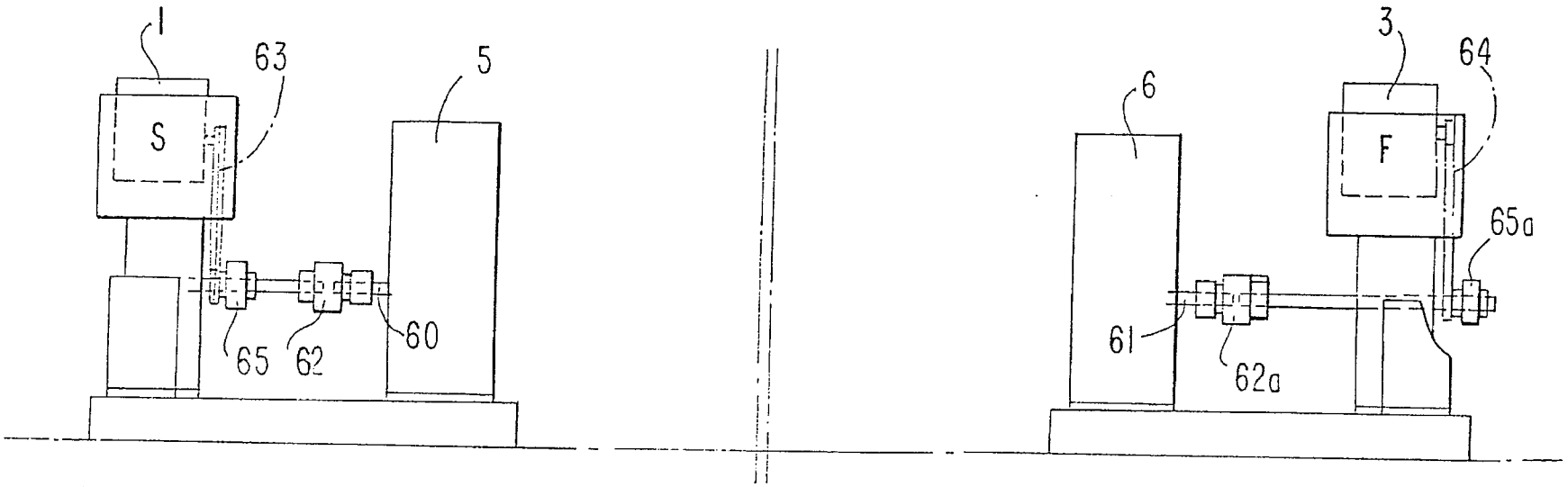
FIG. 7 is a view showing a preferable arrangement of coupling means for a stationary shooting and catching mechanism.

FIG. 7 schematically shows the arrangement of coupling means for the shooting and catching mechanism, with which it can be separated from the main drives. The main drives 5 and 6 have respectively an output shaft 60 and 61 running with a rotary speed ratio 1:1 with respect to the cam shaft 38 of FIG. 3. The rotary movement of the output shafts 60 and 61 is transmitted through the coupling means 62 and 62*a* over the chain drive 63 to the shooting mechanism 1 and over the chain drive 64 to the catching mechanism 3. Preferably overloading couplings 65 and 65*a* are provided in this drive system.

Figure 8:
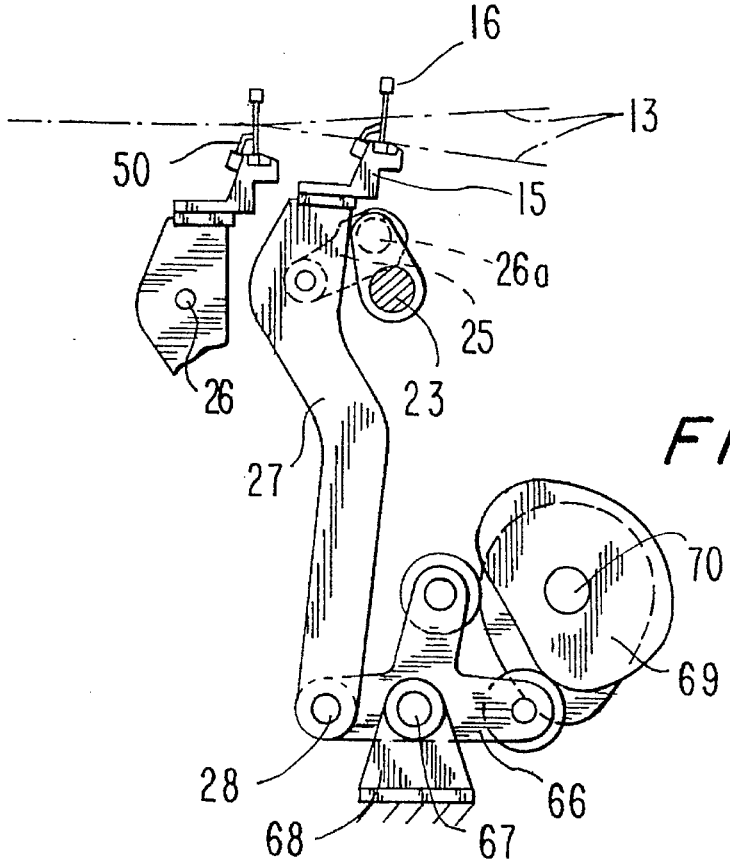

FIG. 8 shows an example of an alternative embodiment. The guiding elements 50 are fixedly connected with the sley carrier 15 and arranged in a fixed position relative to the reed 16. The support 37 is reciprocatingly movable around the rotary point 28 in the above described manner through the crankshaft 23 and crank arm 25. The rotary point 28 is located on a roller lever 66 which has its rotary point 67 in the bearing 68. By means of a complementary cam disc 69 which sits on a drive shaft 70, the sley support 27 with the elements 15, 16 and 50 mounted on it is lowered after performed shooting charge so far that the guiding elements 50 during the sley impact are no longer located in the region of the weaving shed 13. For the position of the shooting charge in the rear sley position, the sley support 27 with the elements 15, 16 and 50 mounted on it is respectively lifted again. They sley supports 27 is a part of a kinematic quadrilateral link 26, 26*a*, 28, 67 arranged in the sley drive with the crankshaft 23.

FIG. 9 schematically shows another embodiment in which the shooting mechanism 1 and the catching mechanism 3 are fixedly connected with the sley carrier 15 and reciprocate with it.

It will be understood that each of the elements described above, or two or more together, may also find a useful application in other types of constructions differing from the types described above.

While the invention has been illustrated and described as embodied in a full width power loom and a method of weaving with the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A full width power loom for producing flat woven paper machine webs and other articles with warp and weft threads with widths more than 6 meters, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley; means for moving said guiding elements synchronously with said sley; and means for moving said guiding elements relatively to said sley so that a second movement is superimposed on said guiding elements, said means for moving said guiding elements relatively to said sley including means providing turning of said guiding elements about a rotary point which is arranged on said sley and connected at a distance from said rotary point to a lever mounted pivotably on a fixed axis.

2. A full width power loom as defined in claim 1, wherein said means for moving said guiding elements relatively to said sley is formed so that said second movement is superposed on said sley.

3. A full width power loom as defined in claim 1 and, said means for moving including a guiding rail turnable about rotary point arranged on said sley, said guiding elements being mounted on said guiding rail.

4. A full width power loom as defined in claim 1, wherein said sley has a reed which in a front reversing point of said sley is arranged perpendicularly to a central shed plane.

5. A full width power loom as defined in claim 1; and further comprising means for mechanically synchronizing the movements of said sley and said guiding elements and including a synchronizing shaft.

6. A full width power loom as defined in claim 1; and further comprising means for arranging said guiding elements and said sley so that a movement of said guiding elements is performed from a movement of said sley.

7. A full width power loom as defined in claim 6; and further comprising a link system providing the movement of said guiding elements from the movement of said sley.

8. A full width power loom as defined in claim 1, wherein said shooting and catching mechanism with said sley is formed swingable; and further comprising means for swinging said shooting and catching mechanism with said sley.

9. A full width power loom for producing flat woven paper machine webs and other articles with warp and weft threads with widths more than 6 meters, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley; means for moving said guiding elements synchronously with said sley; a lever having a stationary rotary point, said guiding elements being fixedly mounted on said sley; and means for turning said sley around a rotary point which is turnably articulated on said lever.

10. A full width power loom as defined in claim 9; and further comprising a cam disc which drives said lever.

11. A full width power loom for producing flat woven paper machine webs and other articles with warp and weft threads with widths more than 6 meter, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley means for moving said guiding elements synchronously with said sley; means for moving said guiding elements relative to said sley and formed so that at least one of said guiding elements and said sley being movable so that a second movement is superimposed on said at least one of said guiding elements and said sley; and a joint crankshaft which provides the superposed movements, said drive shaft being formed as a crankshaft with a connecting rod for driving said sley, said guiding elements being mounted on a guiding rail turnably arranged on said sley, said drive shaft having a bearing ring for said guiding rail.

12. A full width power loom for producing flat woven paper machine webs and other articles with warp and weft threads with widths more than 6 meter, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley; means for moving said guiding elements synchronously with said sley, said sley having more than two sley supports which form a part of a kinematic quadrilateral link; and a sley drive provided with a crankshaft, said quadrilateral link being arranged in said sley drive.

13. A full width power loom for producing flat woven paper machine webs and other articles with warp and weft threads with widths more than 6 meter, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley; means for moving said guiding elements synchronously with said sley; means for moving said guiding elements relative to said sley and formed so that at least one of said guiding elements and said sley being movable so that a second movement is superimposed on said at least one of said guiding elements and said sley; a crankshaft which provides the superposed movements, said drive shaft being formed as a crankshaft with a connecting rod for driving said sley; and a drive for driving said crankshaft and including at least one cam disc transmission.

14. A full width power loom as defined in claim 13, wherein said drive for said crankshaft includes a plurality of said at least one cam disc transmissions which are arranged symmetrically relative to a machine center and formed as complementary cam disc transmissions.

15. A full width power loom for producing flat woven paper machine webs and other articles with warp and weft threads with widths more than 6 meters, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley; means for moving said guide elements synchronously with said sley; a main weaving unit, said shooting and catching mechanism being formed separable from said main weaving units; and means for releasing said catching mechanism.

16. A full width power loom for producing flat woven paper machine webs and other articles with warp and weft threads with widths more than 6 meter, comprising a sley reciprocatable in a direction of warp threads; a thread introducing element; guiding elements for guiding said thread introducing element and connected with said sley, said thread introducing element being formed as a projectile; a shooting and catching mechanism provided for said projectile, said guiding elements exclusively guiding said projectile and being movable synchronously with said sley means for moving said guiding elements synchronously with said sley; means for moving said guiding elements relative to said sley and formed so that at least one of said guiding elements and said sley being movable so that a second movement is superimposed on said at least one of said guiding elements and said sley, said means for moving said guiding elements relatively to said sley including a drive for the superposed movement and formed as linear drive.

17. A full width power loom as defined in claim 16, wherein said linear drive includes a cylinder-piston unit.

* * * * *